US008695130B2

(12) United States Patent
Cicchelli

(10) Patent No.: US 8,695,130 B2
(45) Date of Patent: Apr. 15, 2014

(54) I-BEAM BASE CONSTRUCTION FOR TUB/SHOWER

(75) Inventor: Dennis J. Cicchelli, Livonia, MI (US)

(73) Assignee: Masco Corporation, Taylor, MI (US)

( * ) Notice: Subject to any disclaimer, the term of this patent is extended or adjusted under 35 U.S.C. 154(b) by 1070 days.

(21) Appl. No.: 12/721,957

(22) Filed: Mar. 11, 2010

(65) Prior Publication Data

US 2011/0219532 A1 Sep. 15, 2011

(51) Int. Cl.
*A47K 3/00* (2006.01)

(52) U.S. Cl.
USPC ..... 4/592

(58) Field of Classification Search
USPC ..... 4/538–595
See application file for complete search history.

(56) References Cited

U.S. PATENT DOCUMENTS 2,534,147 A * 12/1950 Rodman ..... 4/592
2,697,231 A * 12/1954 Strand ..... 4/595
2,784,417 A * 3/1957 Strand ..... 4/595
2,820,228 A * 1/1958 Rodman ..... 4/593
2,841,795 A * 7/1958 Pelicano ..... 4/592
3,046,568 A * 7/1962 Holberson ..... 4/593
3,561,019 A * 2/1971 Roland ..... 4/593
3,605,352 A * 9/1971 Ruggles ..... 52/35
3,934,278 A * 1/1976 Schrock ..... 4/593
4,290,154 A * 9/1981 Benjamin ..... 4/538
4,551,869 A * 11/1985 Whitney ..... 4/592
4,586,204 A * 5/1986 Daniels ..... 4/541.4
5,195,192 A * 3/1993 Garde ..... 4/585
5,241,713 A * 9/1993 Wang ..... 4/593
5,261,130 A * 11/1993 Kendall ..... 4/613
5,341,527 A * 8/1994 Schmidt et al. ..... 4/592
5,430,898 A * 7/1995 Wang ..... 4/592
5,459,888 A * 10/1995 Chen ..... 4/593
5,477,568 A * 12/1995 Wang ..... 4/592
5,494,718 A * 2/1996 Adams et al. ..... 428/35.7
5,619,760 A * 4/1997 Wang ..... 4/592
5,903,934 A * 5/1999 Sears, III ..... 4/538
6,401,983 B1 * 6/2002 McDonald et al. ..... 222/181.2

* cited by examiner

*Primary Examiner* — Lori Baker
(74) *Attorney, Agent, or Firm* — Carlson, Gaskey & Olds, PC

(57) ABSTRACT

A support for a shower or a tub has a board adapted to be disposed on a bottom of a shower or a tub and has an I-beam attached to the board to support the board along a dimension thereof. The support may have an abutment that is attached to the board that supports a skirt that is integrally attached to the tub or shower.

12 Claims, 2 Drawing Sheets

I-BEAM BASE CONSTRUCTION FOR TUB/SHOWER

TECHNICAL FIELD

This patent application relates to supports for tubs and showers and more particularly to a beam support.

BACKGROUND

Modern showers and bathtubs are typically constructed of strong, light weight materials, such as fiber reinforced resins among others, that may require support to hold water and people using them. Given the weight of water showers and bathtubs, in particular, have to support, the weight of shower and bath users, and government requirements, structural support for showers and bathtubs is becoming more and more important.

In the past, bathtubs and shower bases were made of metal like stainless steel or cast iron over which enamel was secured. The strength of the materials generally gave the tubs and showers the necessary support and additional support was not required.

Some prior art applications attach a backer board to the bottom of the tub and placed a rabbeted board into a slot in the backer board to provide support for the tub. These boards, however, were prone to breakage. Another mechanism has a metallic cradle in which the tub sat. However, such cradle is heavy, costly and difficult to form.

SUMMARY

According to an embodiment of the invention a support for a shower or a tub has a board adapted to be disposed on a bottom of a shower or a tub and has an I-beam attached to the board to support the board along a dimension thereof.

According to an aspect of the embodiment, an abutment is attached to the board that supports a skirt that is integrally attached to the tub or shower.

These and other features can be best understood from the following specification and drawings, the following of which is a brief description.

DETAILED DESCRIPTION

Figure 1:
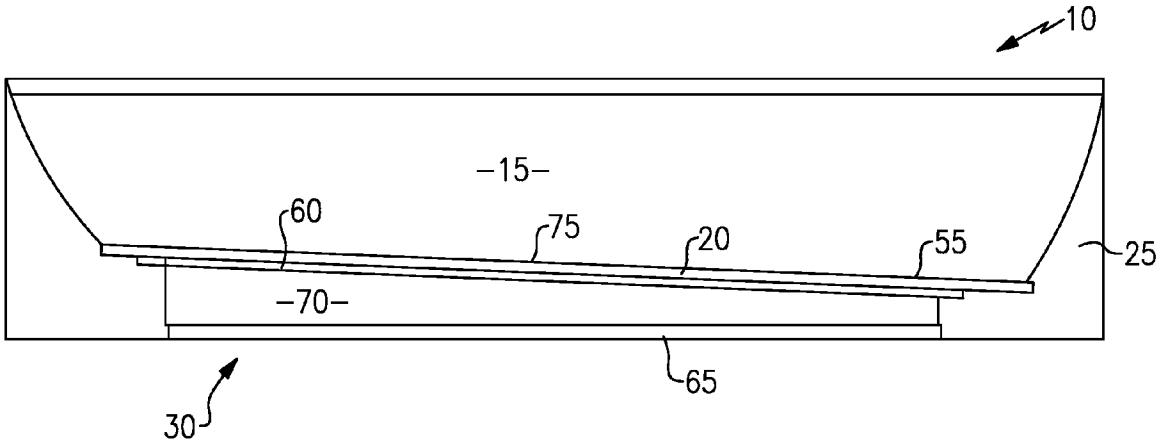
FIG. 1 is a back, side view of a skirted tub and a support.

FIG. 1 shows a bathtub 10, including the tub 15, a base 20, a skirt 25, and a support 30.

Figure 2:
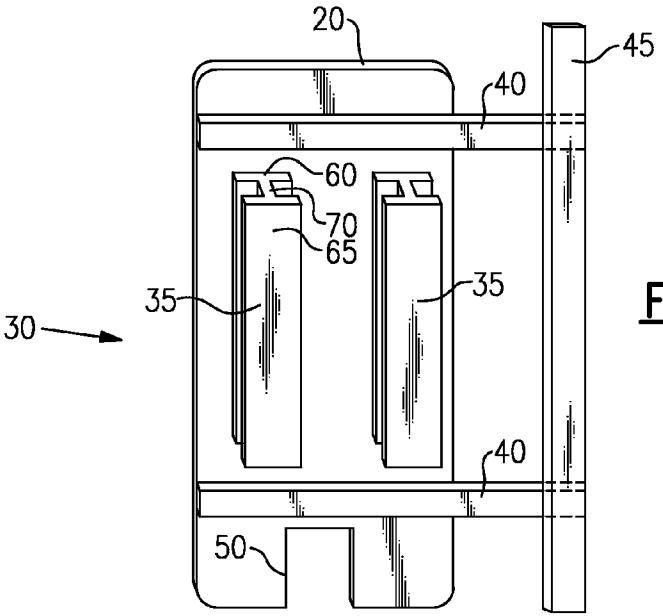
FIG. 2 is an embodiment of the support of the tub shown in FIG. 1.

Referring now to FIG. 2 shows a bottom view of an embodiment of the support 30. The support 30 includes the base 20 (e.g., a backer board), a pair of I-beams 35 attached to the base 20, a pair of boards 40 and an abutment 45 that takes the form of an outrigger. The base 20 may be integrally formed with the tub 15 as is known in the art, or it may be independent of the tub 15, as will be discussed herein. The I-beams 35 are symmetrically placed on the base 20 along a length thereof to provide support to the tub 15. The boards (or strapping) 40 are transverse to the I-beams 35 and attach transversely again to the abutment 45. The I-beams 35 may be attached to the base 20 by glue, screws, nails or staples or such other means as are known in the art. Similarly, the boards 40 are attached to the base 20 and to the outrigger 45 by means of glue, screws, nails or staples or such other means as are known in the art. While the support 30 is usually made of wood, the support 30 may be made of other materials such as plastics or the like, or other light, strong materials. The base 20 may have a cutout 50 to allow the passage of water through outlets 55 (see FIG. 1) placed in the tub 15.

Each I-beam 35 may have a top plate 60, a bottom plate 65 and a web 70 connecting the top and bottom plate. The height of the web 70 slopes along its length to offset any cant of the bottom 75 (to help the tub drain) of the tub 15 to keep the bath tub 10 level.

Figure 3:
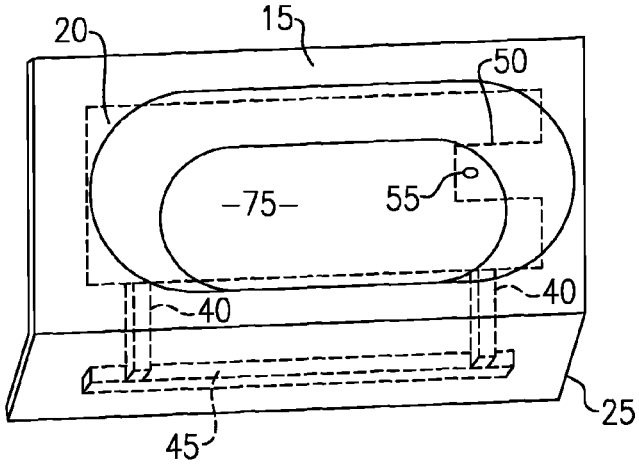
FIG. 3 is a perspective view of the tub of FIG. 1 partially in phantom.

Referring now to FIG. 3, the top perspective view of an embodiment of the support 30 is shown. The boards 40 extend from the base 20 and attach to the abutments 45. The abutment 45 and the ends of the boards impinge against the skirt 25 to import a structural rigidity thereto. If a skirt 25 is impacted in anyway, the outrigger 45 and boards 40 should minimize damage to that skirt 25.

Figure 4:
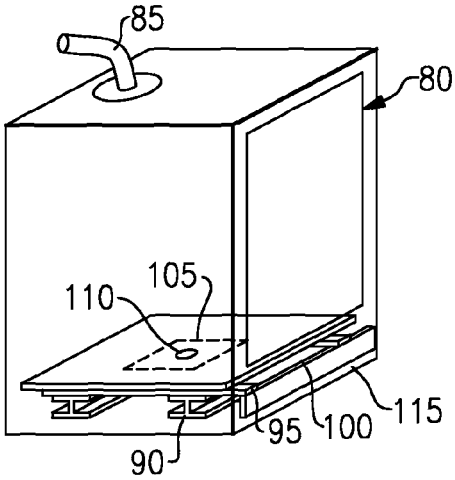
FIG. 4 shows an embodiment incorporated into a shower.

Referring now to FIG. 4, a further embodiment of the invention is shown in which base 30 is used with a shower enclosure 80 having a shower head 85 to add water to the shower enclosure 80 for use. The shower enclosure 80 has an opening 110 that aligns with the cutout 105 of the base 30 (See also FIG. 5).

Figure 5:
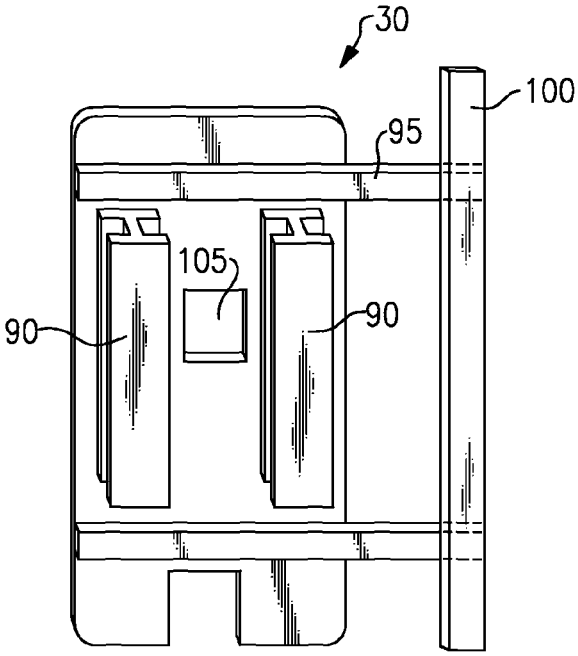
FIG. 5 is a bottom view of the shower enclosure of FIG. 4.

Referring now to FIG. 5, a bottom of the shower 80 of FIG. 4 is shown. As with the bath base support 30, as noted hereinabove, the shower enclosure 80 support base 30 has a pair of I-beams 90, boards 95, and an abutment 100. A primary difference between the shower base 80 and the support 30 is that a cutout 105 is placed in the middle of the support 30 to align with shower outlet 110.

As with the bathtub 10, the abutment 100 and the boards 95 impinge upon a shower skirt 115 to apply rigidity thereto.

While the support 30 may be made integrally with the shower or bath, the support 30 may also be constructed separately from a tub or shower by normal construction practice and shipped with the tub or shower or conveyed separately is space needed for installation is tight.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A tub or a shower support comprising:

a backer board positioned underneath a bottom of a tub or shower, said backer board having a length extending in a longitudinal direction and a width extending in a lateral direction; and at least one I-beam attached to a bottom of said backer board to extend in said longitudinal direction.

2. The tub or shower support of claim 1 wherein said at least one I-beam comprises at least two I-beams spaced part from each other and extending in said longitudinal direction, each I-beam discretely supporting said tub or said shower.

3. The tub or shower support of claim 2 including at least one strapping attached to said backer board and extending transversely relative to said at least two I-beams.

4. The tub or shower support of claim 3 including an abutment spaced apart from said backer board and extending in said longitudinal direction to provide support to a skirt of said tub or said shower, said at least one strapping being directly attached to said abutment.

5. The tub or shower support of claim 4 wherein said at least one strapping comprises at least two strappings spaced apart from each other and extending in said lateral direction, each of said strappings being directly attached to said abutment.

6. The tub or shower support of claim 1 wherein said at least one I-beam has a top plate, a bottom plate, and a web connecting said top and said bottom plate, and wherein a height of said web slopes along a length of said at least one I-beam to offset any cant of said bottom of said tub or said shower.

7. The tub or shower support of claim 1 including at least one strapping attached to said backer board and extending transversely relative to said at least one I-beam.

8. The tub or shower support of claim 7 including an abutment spaced apart from said backer board and extending in said longitudinal direction to provide support to a skirt of said tub or said shower, said at least one strapping being directly attached to said abutment.

9. The tub or shower support of claim 8 wherein said at least one strapping comprises at least two strappings spaced apart from each other and extending in said lateral direction, each of said strappings being directly attached to said abutment.

10. The tub or shower support of claim 9 wherein said at least one I-beam comprises at least two I-beams laterally spaced apart from other and extending in said longitudinal direction, each I-beam discretely supporting said tub or said shower.

11. The tub or shower support of claim 10 wherein said at least two I-beams are positioned longitudinally between said two strappings.

12. The tub or shower support of claim 10 wherein said abutment extends longitudinally beyond each of said strappings.

* * * * *

UNITED STATES PATENT AND TRADEMARK OFFICE

CERTIFICATE OF CORRECTION

PATENT NO. : 8,695,130 B2
APPLICATION NO. : 12/721957
DATED : April 15, 2014
INVENTOR(S) : Cicchelli It is certified that error appears in the above-identified patent and that said Letters Patent is hereby corrected as shown below:

IN THE CLAIMS:

Claim 10, column 4, line 12; insert --each-- after "from"

Signed and Sealed this
Twenty-ninth Day of July, 2014

Michelle K. Lee

Michelle K. Lee
*Deputy Director of the United States Patent and Trademark Office*